US006902299B2

(12) United States Patent
Zhan et al.

(10) Patent No.: US 6,902,299 B2
(45) Date of Patent: Jun. 7, 2005

(54) LONG DISTANCE ILLUMINATOR

(75) Inventors: James Zhan, Burnaby (CA); Junjiang Han, Beijing (CN); Meigen Xia, Shanghai (CN); Meibo Zhang, Beijing (CN)

(73) Assignee: Cantronic Systems Inc., British Columbia (CA)

( * ) Notice: Subject to any disclaimer, the term of this patent is extended or adjusted under 35 U.S.C. 154(b) by 147 days.

(21) Appl. No.: 10/377,226

(22) Filed: Feb. 27, 2003

(65) Prior Publication Data

US 2004/0170017 A1 Sep. 2, 2004

(51) Int. Cl.[7] ..... F21V 29/00

(52) U.S. Cl. ..... 362/294; 362/285; 362/184; 362/188; 362/800

(58) Field of Search ..... 313/500, 512; 40/541; 257/722, 712, 721; 345/905; 362/545, 547, 553, 555, 573, 574, 218, 240, 244, 245, 255, 294, 800, 373

(56) References Cited

U.S. PATENT DOCUMENTS

| | | | | | |
|---|---|---|---|---|---|
| 4,185,891 | A | | 1/1980 | Kaestner | 350/167 |
| 4,211,955 | A | | 7/1980 | Ray | 315/53 |
| 4,467,193 | A | | 8/1984 | Carroll | 250/216 |
| 4,547,701 | A | | 10/1985 | Taylor et al. | 313/500 |
| 4,707,585 | A | | 11/1987 | Monteith et al. | 219/121 |
| 4,907,044 | A | | 3/1990 | Schellhorn et al. | 357/17 |
| 4,912,316 | A | * | 3/1990 | Yamakawa | 250/221 |
| 4,935,665 | A | | 6/1990 | Murata | 313/500 |
| 4,947,291 | A | | 8/1990 | McDermott | 362/19 |
| 5,083,192 | A | | 1/1992 | Rzeznik et al. | 357/74 |
| 5,224,773 | A | | 7/1993 | Arimura | 362/227 |
| 5,396,069 | A | | 3/1995 | Craig et al. | 250/330 |
| 5,408,084 | A | | 4/1995 | Brandorff et al. | 250/208 |
| 5,660,461 | A | | 8/1997 | Ignatius et al. | 362/241 |
| 5,752,766 | A | * | 5/1998 | Bailey et al. | 362/250 |
| 5,890,794 | A | | 4/1999 | Abtahi et al. | 362/294 |
| 6,132,072 | A | | 10/2000 | Turnbull et al. | 362/494 |
| 6,154,362 | A | * | 11/2000 | Takahashi et al. | 361/695 |
| 6,161,910 | A | | 12/2000 | Reisenauer et al. | 316/309 |
| 6,286,978 | B1 | * | 9/2001 | Tait et al. | 362/249 |
| 6,290,368 | B1 | | 9/2001 | Lehrer | 362/187 |
| 6,305,818 | B1 | | 10/2001 | Lebens et al. | 362/184 |
| 6,340,868 | B1 | | 1/2002 | Lys et al. | 315/185 |
| 6,357,893 | B1 | * | 3/2002 | Belliveau | 362/285 |
| 6,402,347 | B1 | * | 6/2002 | Maas et al. | 362/294 |
| 6,429,429 | B1 | | 8/2002 | Fohl et al. | 250/353 |
| 6,650,048 | B2 | * | 11/2003 | Wu | 313/512 |
| 6,683,421 | B1 | * | 1/2004 | Kennedy et al. | 315/291 |
| 6,753,553 | B2 | * | 6/2004 | Wu | 257/88 |
| 2002/0134835 | A1 | * | 9/2002 | Kennedy | 235/384 |
| 2004/0012715 | A1 | * | 1/2004 | Gin | 348/375 |

FOREIGN PATENT DOCUMENTS

| | | | |
|---|---|---|---|
| JP | 20022153423 A | * | 5/2002 |
| WO | WO 92/03808 | | 3/1992 |
| WO | WO 99/31560 | | 6/1999 |
| WO | WO 02/15288 | | 2/2002 |

* cited by examiner

*Primary Examiner*—Sandra O'Shea
*Assistant Examiner*—Hargobind S. Sawhney
(74) *Attorney, Agent, or Firm*—Oyen Wiggs Green & Mutala LLP

(57) ABSTRACT

An illuminator, which may be an infrared illuminator, has an array of LEDs. The LEDs are mounted to an apertured substrate. Air flow through apertures in the substrate cools the LEDs. A fan forces air through the apertures. A collimating plate reduces divergence of a light beam issuing from the LEDs. The illuminator is suitable for long range illumination, for example in night vision systems or surveillance systems. An infrared illuminator may be combined with an infrared camera to provide a night vision system.

24 Claims, 6 Drawing Sheets

LONG DISTANCE ILLUMINATOR

TECHNICAL FIELD

The invention relates to illuminators. The invention has particular, but not exclusive, application to infrared illuminators. Infrared illuminators according to the invention may be used in night-vision systems, infrared camera systems, and the like.

BACKGROUND

Infrared cameras can acquire images even in circumstances which appear completely dark to the human eye. Such infrared cameras have application in many fields including stationary and mobile night-vision systems, covert surveillance, and the like. A complete night-vision system includes an infrared camera and a source of infrared illumination. Various types of infrared illumination sources have been proposed.

Some infrared illumination sources generate infrared light using an incandescent bulb. As the incandescent bulb emits light having a broad range of wavelengths, a filter may be provided to filter visible light from the output. Such illumination sources have the disadvantages that they require large amounts of electrical power and are relatively inefficient.

Laser diodes which emit light at infrared wavelengths are now available. Such laser diodes are relatively efficient at converting electrical power into infrared illumination but are undesirably expensive for many applications.

Light emitting diodes (LEDs) which emit infrared radiation are also available. Such light emitting diodes are not particularly bright. Therefore, their use is typically limited to illumination over shorter ranges such as a few meters. Further, the efficiency of infrared LEDs varies with temperature. The efficiency drops off at temperatures which are too high. Some proposed infrared illumination systems use arrays of infrared LEDs to create brighter illumination. In such systems temperature control becomes a problem since the infrared LEDs generate heat as well as infrared radiation.

There is a need for cost effective longer range infrared illuminators.

SUMMARY OF THE INVENTION

The invention relates to illuminators and to systems which incorporate illuminators. Specific embodiments of the invention relate to infrared illuminators and illumination systems.

One aspect of this invention provides an illuminator. The illuminator comprises a housing; a substrate within the housing; and a plurality of LEDs arranged in an array and mounted to the substrate. The substrate is apertured, with at least one aperture adjacent to each of the LEDs in the array. Illuminators according to some embodiments of the invention have a collimating plate located to reduce a divergence of a beam of light issuing from the array of LEDs.

The illuminator may comprise a fan located to cause a flow of air through apertures in the substrate. The substrate may divide the housing into a front portion and a rear portion with the LEDs in the front portion, and the fan in the rear portion. In such cases the fan is operable to drive air out of the housing through an exhaust vent in the rear portion and to draw air from the front portion to the rear portion through the apertures.

Further aspects of the invention and features of specific embodiments of the invention are described below.

BRIEF DESCRIPTION OF THE DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
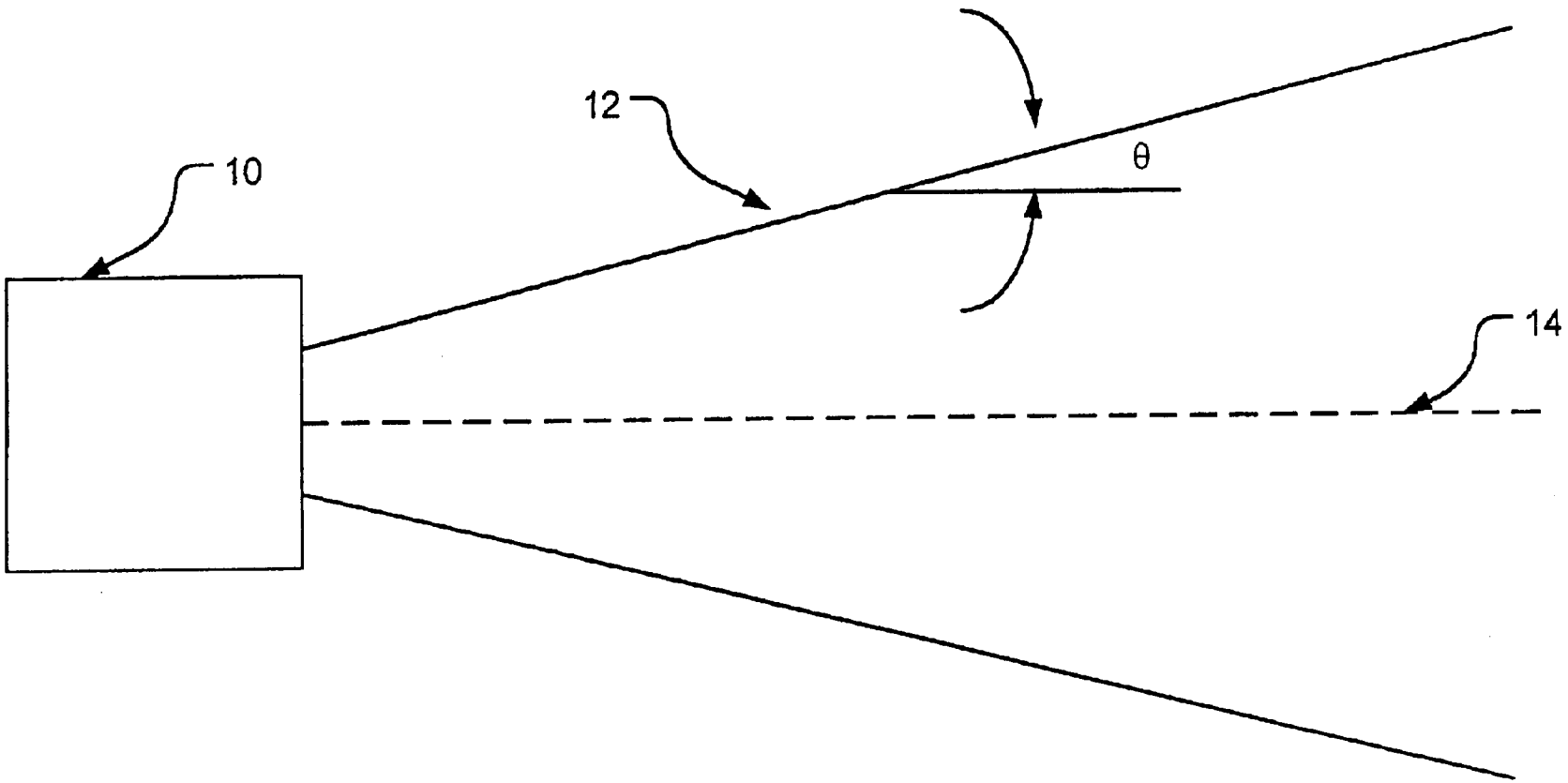
FIG. 1 is a schematic view of an illuminator showing a geometry of a beam of light emitted by the illuminator.

For long-range illumination it is generally desirable that the illuminator provide a beam of light having a small divergence angle. FIG. 1 shows schematically an illuminator 10 which emits a beam of light 12 directed along an axis 14. Beam 12 diverges at an angle $\theta$. In general, for long-range illumination it is desirable that $\theta$ should not exceed about 12 degrees. Most preferably $\theta$ is in the range of about 0 degrees to about 10 degrees. If beam 12 diverges too much then the intensity of light in the beam will fall off undesirably rapidly with distance.

Figure 2:
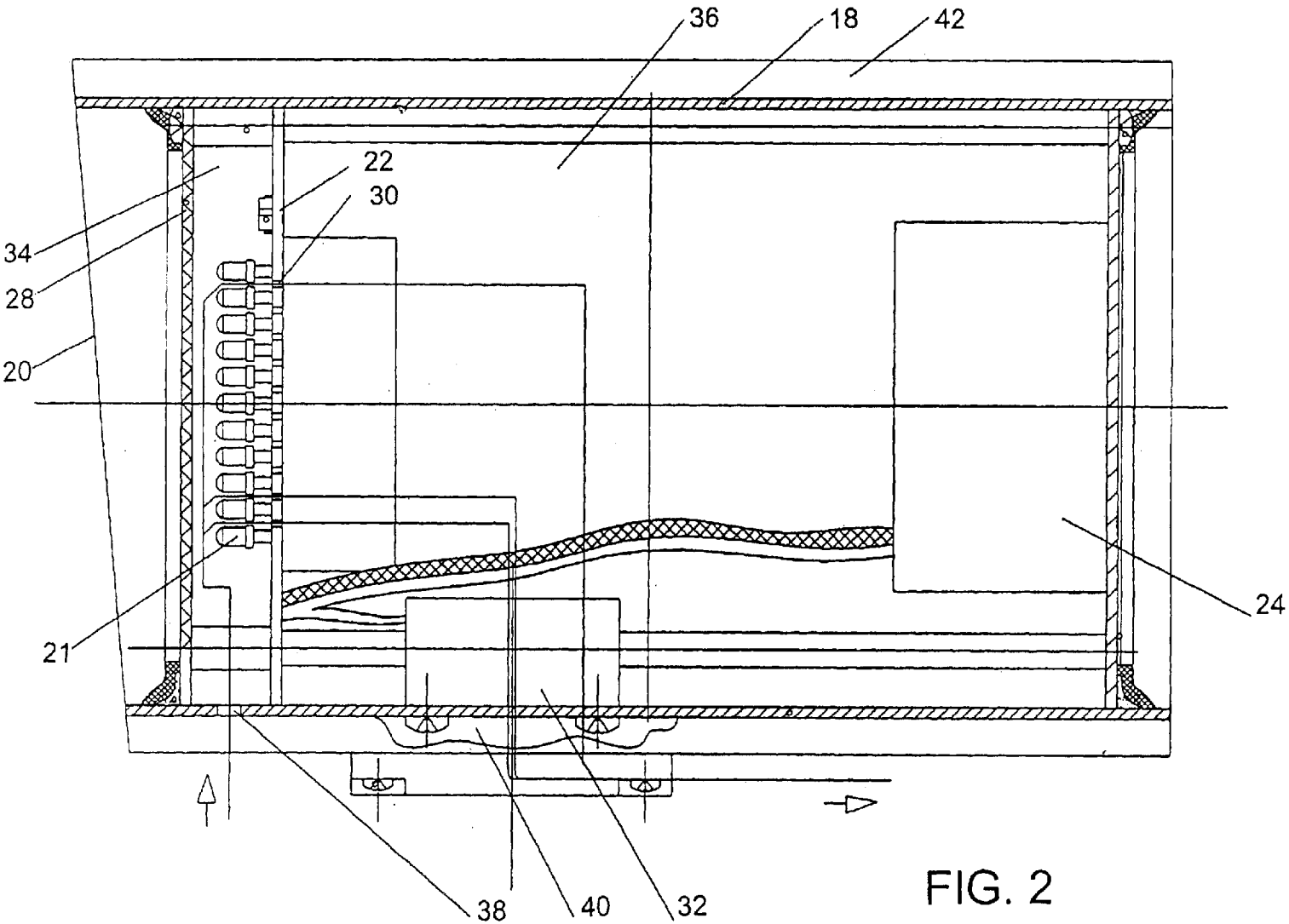
FIG. 2 is a cross section through an illuminator according to the invention.

FIG. 2 shows an infrared illuminator 10 according to one embodiment of the invention. Illuminator 10 comprises a housing 18 within which is located an array 20 of LEDs 21. Where illuminator 10 is an infrared illuminator, LEDs 21 are infrared-emitting LEDs. LEDs 21 may, for example, emit light having wavelengths in the range of 500 nm to 1000 nm. LEDs 21 are mounted to a substrate 22. Power is supplied to LEDs 21 from a suitable power supply 24. In the illustrated embodiment, substrate 22 is a circuit board and power from power supply 24 is delivered to individual LEDs 21 by electrically conductive traces 26 on substrate 22.

Each LED 21 emits a cone of light. For example, one commonly available type of LED emits light in a cone having a viewing angle of 30 degrees. A collimating plate 28 may be provided in front of LEDs 21. Collimating plate 28 shapes light emitted from LEDs 21 into a beam having the desired divergence angle $\theta$.

Collimating plate 28 may have any of a number of different structures. Collimating plate 28 may comprise a conventional lens or an array of conventional lenses. Preferably, however, collimating plate 28 is thin and lightweight. For example, collimating plate 28 may comprise a flat lens such as a Fresnel lens or a holographic lens or an array of such lenses. Such lenses can provide acceptable optical properties and are typically lighter in weight and lower in cost than conventional lenses. Although it is typically not necessary, collimating plate 28 may comprise multiple elements.

If LEDs 21 are of a type which emits a beam of light having a divergence angle which is the same as, or less than, a divergence angle desired for beam 12 then a collimating plate 28 may not be required.

Collimating plate 28 may optionally be tinted to partially or substantially completely absorb or reflect light having wavelengths outside of a band desired for beam 12.

Figure 3B:
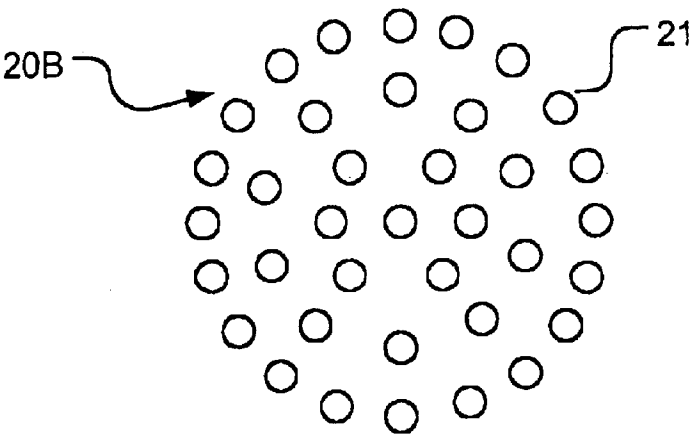
FIGS. 3A, 3B and 3C are elevational views which show possible but non-limiting arrangements for LEDs in LED arrays.
Figure 3C:
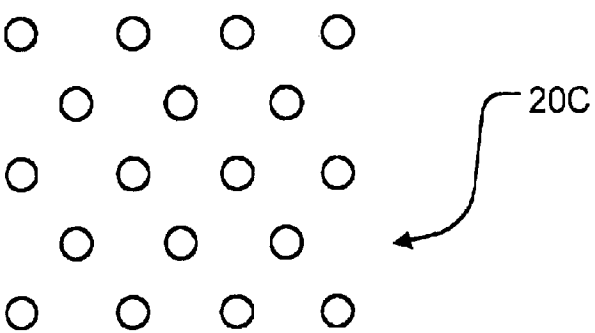
Figure 3A:
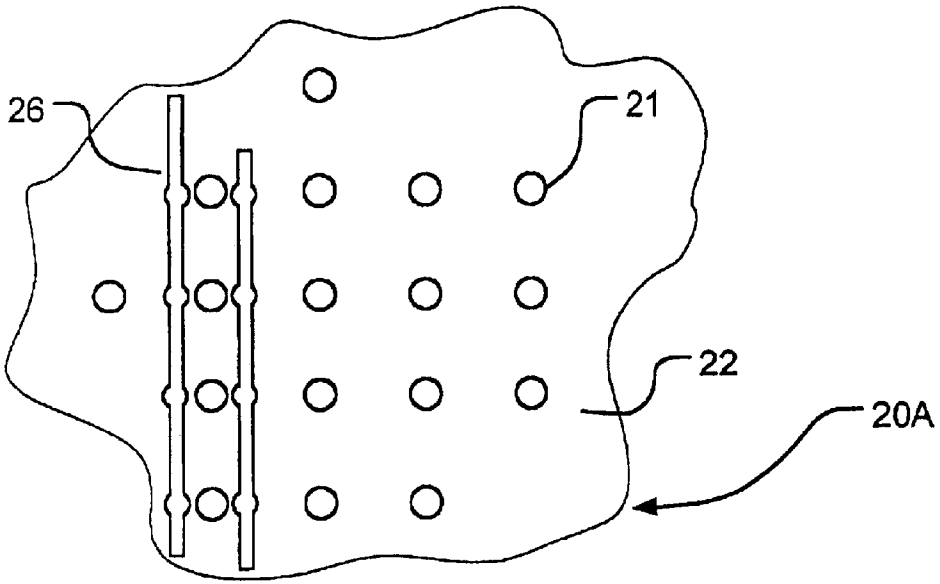

LEDs 21 may be arranged in any suitable manner within array 20. FIGS. 3A through 3C show some possible but non-limiting arrangements for LEDs 21. FIG. 3A shows an array 20A wherein LEDs 20 are arranged in a rectangular grid pattern. FIG. 3B shows an array 20B wherein LEDs 21 are arranged in a series of concentric circles. FIG. 3C shows an array of LEDs 21 wherein LEDs 21 are arranged in a triangular pattern.

Array 20 contains a number of LEDs 21 sufficient to provide a desired total power output. For example, the aggregate power of LEDs 21 in array 20 may be in excess of 25 W or even in excess of 50 W. In some embodiments array 20 may comprise 400 or more LEDs 21. Illuminators according to some embodiments of the invention have 560 or more LEDs 21.

Each LED 21 may consume, for example, about 75 mW of electrical power when it is in operation. Such LEDs typically emit 42 mW of light energy. In preferred embodiments of the invention, LEDs 21 of array 20 are concentrated so that the LEDs 21 within a circular area of 3 cm diameter consume at least 3.6 W when they are in operation. Preferably, LEDs 21 are arranged in array 20 so that there is an average of at least 6 LEDs 21 per square centimeter in at least a central area of array 20. In some embodiments, a ratio of an aggregate power of the LEDs to an area of a surface of substrate 22 on which the LEDs are mounted is at least 400 mW/cm$^2$.

Illuminator 10 is constructed to provide air circulation to prevent LEDs 21 from overheating. Substrate 22 is perforated by apertures 30. Apertures 30 may be conveniently arranged in an array with one or more apertures 30 adjacent to each LED 21. Apertures 30 may comprise holes. In some specific embodiments apertures 30 are round holes having diameters in the range of 1.5 mm to 2 mm.

In some embodiments, in at least a central circular area of array 20 having a diameter of 3 cm the aggregate area of apertures 30 is at least 2.5 mm$^2$ per 0.1 W of LEDs 21 within the circular area. In some embodiments, a ratio of the aggregate area of the apertures to a total number of the LEDs on substrate 22 is at least 1.8 mm$^2$ per LED.

Each of the LEDs has one or more nearest-neighboring LEDs. The nearest-neighboring LEDs are one or more LEDs which are closer to the LED in question than any other ones of the LEDs. In some embodiments, for each of the LEDs, within a circle having a radius equal to a distance from the LED to its nearest-neighboring LED, there are apertures having an aggregate area of at least 7 mm$^2$ and preferably at least 9 mm$^2$ multiplied by a power of the LED in Watts.

A fan 32 is provided in housing 18. Fan 32 causes motion of the air within housing 18. The moving air passes through apertures 30. In the illustrated embodiment of the invention, substrate 22 separates the inside of housing 18 into a front portion 34 and a rear portion 36. Inlet vents 38 are located in a lower part of front portion 34. An exhaust vent 40 is located in rear portion 36. Fan 32 draws air in by way of inlet vents 38, past LEDs 21 and through apertures 30 and then out through exhaust vent 40. The air cools LEDs 21. The air flow past LEDs 21 has a substantial component perpendicular to substrate 22.

In preferred embodiments, within an area of array having a diameter of 3 cm there are LEDs 21 which have an aggregate power consumption of 1,500 mW. The same 3 cm diameter area may include 20 or more and preferably 40 or more LEDs 21.

The apertures are distributed in a pattern so that at least one of the apertures is adjacent to each LED 21. In one embodiment, for each of a plurality of LEDs 21 within an area having a radius equal to a distance from the LED 21 to a nearest-neighbouring LED 21 there are apertures dimensioned to provide an air flow through the apertures of at least 1 cm$^3$/sec when fan 32 is operating. In other embodiments, for each of a plurality of LEDs 21 in the same circular areas the apertures have an aggregate area of at least 9 mm$^2$ multiplied by a power of the LED in watts.

In some embodiments of the invention, the apertures in substrate 22 and the fan are constructed to provide a flow of air through substrate 22 of at least 25 cm$^3$/s. In some embodiments, within a circular area having a diameter of 3 cm or less there are sufficient apertures in the substrate to provide an air flow of at least 18 cm$^3$/sec when fan 32 is operating. In some embodiments, for each of a plurality of the LEDs, within a circular area having a radius equal to a distance from the LED to a nearest-neighboring LED, there are apertures dimensioned to provide a flow of air through the apertures within the circular area of at least 1 cm$^3$/s when fan 32 is operating.

In the illustrated embodiment, housing 18 is fabricated at least in part from a material, such as aluminum, which has a high thermal conductivity. Housing 18 has cooling fins 42 on its outer surface. Cooling fins 42 help to maintain the interior of housing 18 cool.

Figure 4:
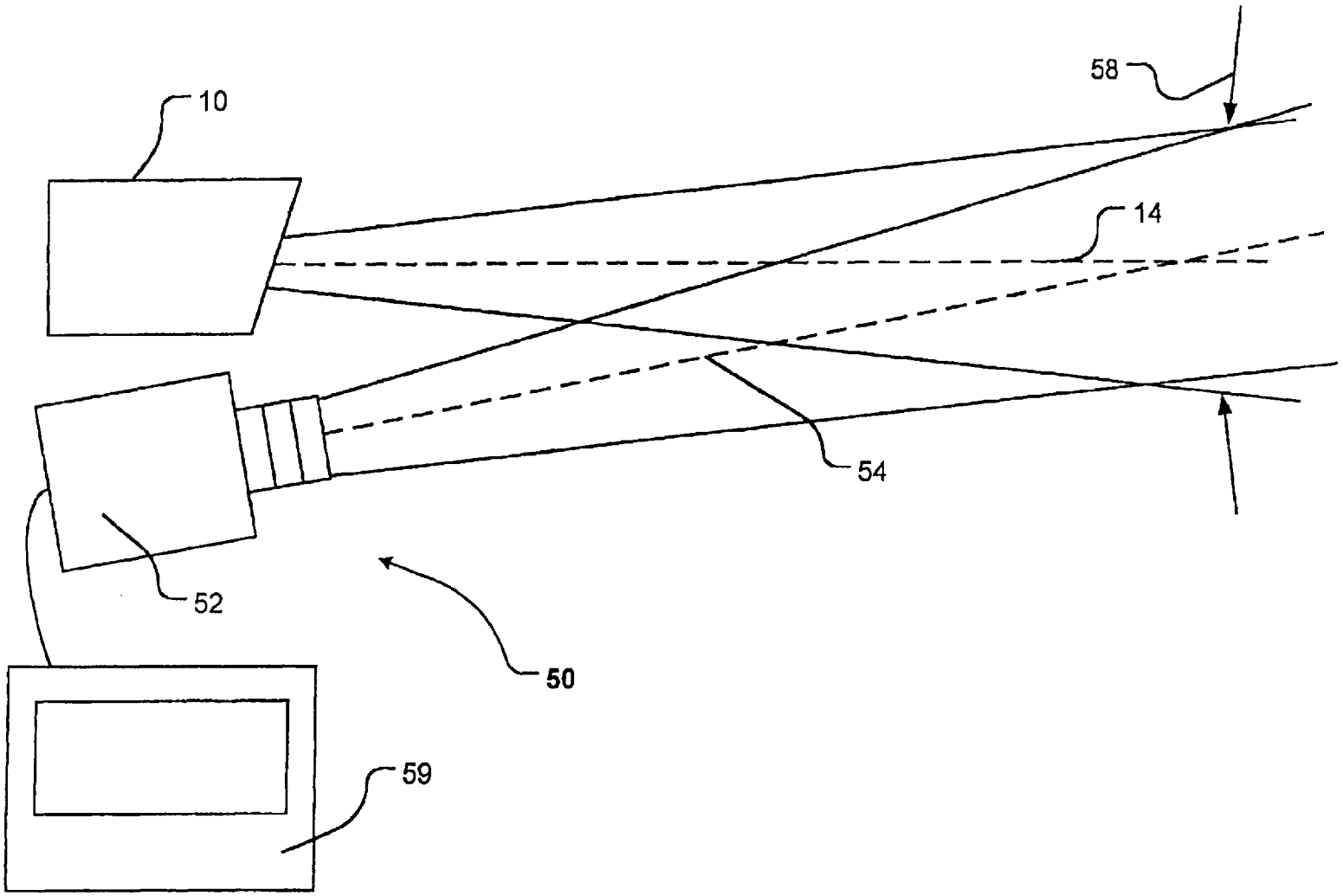
FIG. 4 is a block diagram of a night-vision system according to the invention.

FIG. 4 shows a night vision system 50 according to the invention. Night vision system 50 has an illuminator 10 which emits an infrared light beam 12 directed along axis 14. Night vision system 50 also comprises an infrared-sensitive camera 52. Camera 52 may be a CCD camera and is preferably a video camera. Camera 52 has an optical axis 54. While optical axis 54 is oriented at a slight angle with respect to axis 14, at a desired viewing distance, optical axis 54 may be treated as being directed generally parallel to axis 14. At the desired viewing distance, a field of view 58 of camera 52 is substantially co-extensive with beam 12 at the desired viewing distance. Output from camera 52 is displayed on a monitor 59.

Figure 5:
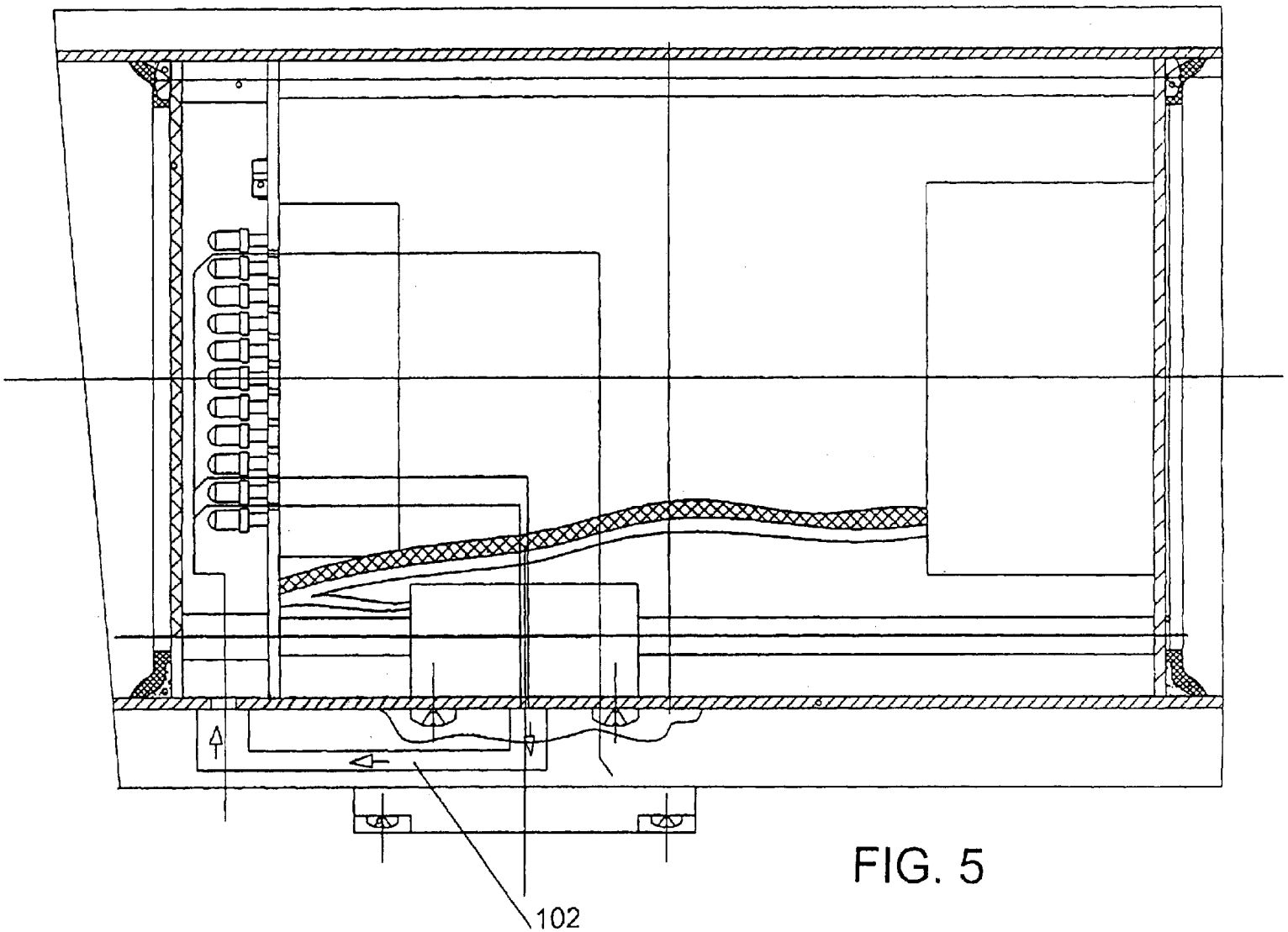
FIG. 5 is a cross sectional view through an illuminator according to the invention which has a recirculating cooling system; and, FIG. 6 is a cross sectional view through an illuminator according to an embodiment of the invention in which the substrate is curved.

FIG. 5 shows an illuminator 100 according to an alternative embodiment of the invention. Illuminator 100 is substantially the same as illuminator 10 of FIG. 2 with the exception that a conduit 102 connects inlet vents 38 and exhaust vents 40. A coolant fluid, which may be air, another gas, such as nitrogen, argon or the like, or a suitable liquid is recirculated within illuminator 100 to control the temperatures of LEDs 21. Where a liquid coolant is used, fan 32 is replaced with a suitable pump. Conduit 102 may optionally comprise walls which are thermally conductive so as to dissipate heat from the coolant circulating through conduit 102. Conduit 102 may comprise heat-conducting fins on its inner and/or outer surfaces.

In the embodiment of FIG. 5, fan 32 is disposed to circulate a coolant gas in a circuit which extends through conduit 102 and through apertures 30.

Where a component (e.g. an assembly, device, circuit, etc.) is referred to above, unless otherwise indicated, reference to that component (including a reference to a "means")

should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. For example:

While power supply 24 is shown in FIG. 2 as being inside housing 18, power supply 24 could also be external to housing 18.

This invention is not limited to infrared illuminators. LEDs which produce visible or other non-infrared wavelengths may also be used in illuminators according to the invention for illumination in other wavelength ranges.

Figure 6:
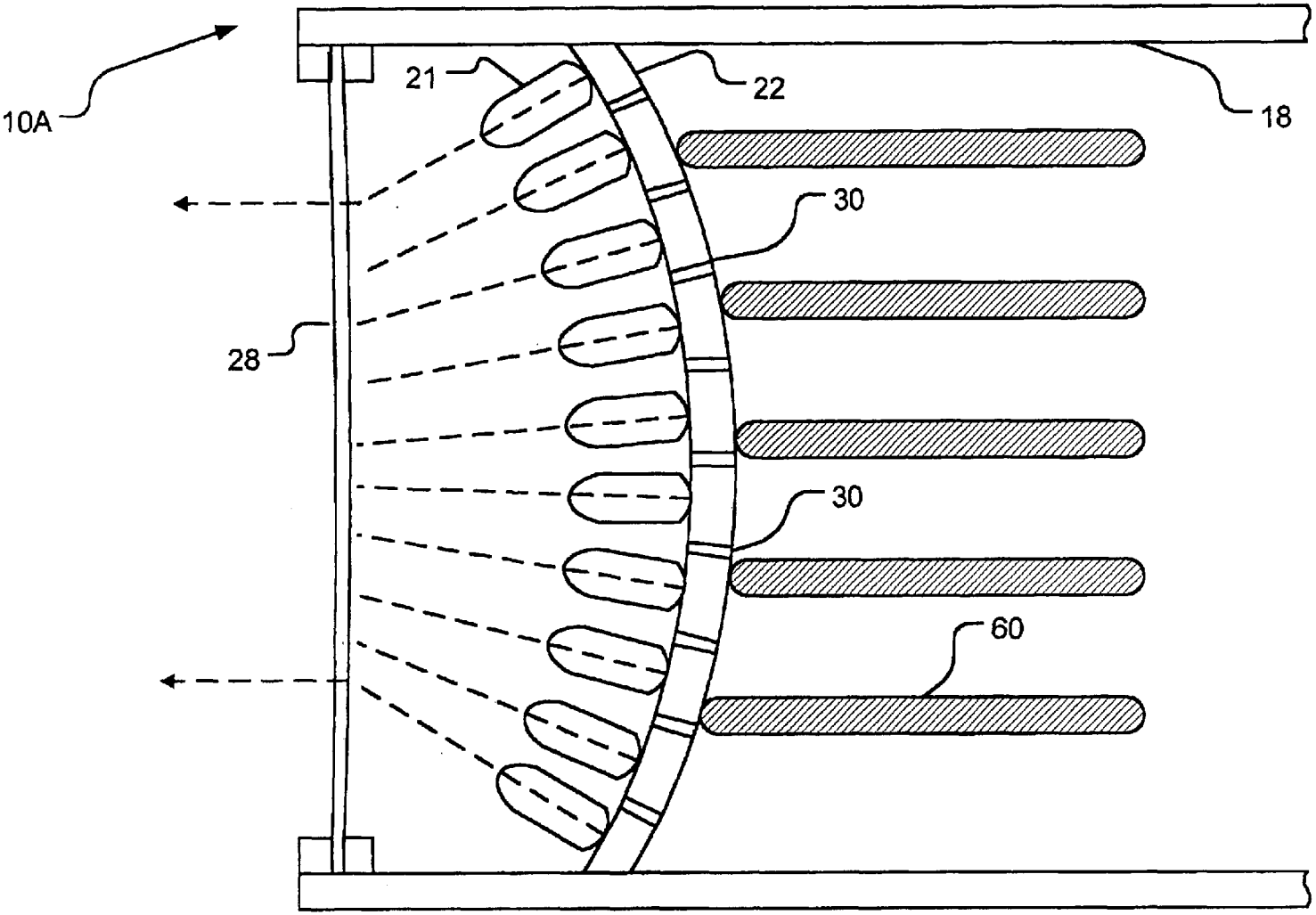

Substrate 22 is not necessarily planar. For example, FIG. 6 shows an illuminator 10A according to an embodiment of the invention wherein substrate 22 is curved. In illuminator 10A substrate 22 comprises a flexible circuit board which is fastened in housing 18 in a curved configuration. Substrate 22 may be bent into a parabolic curve, for example. In the embodiment of FIG. 6, substrate 22 is held against abutment surfaces 60 which are arranged in a parabolic arc. In this embodiment, collimating plate 28 comprises a convex lens. In the embodiment of FIG. 6, the optical axis of each LED 21 is substantially normal to substrate 22.

Accordingly, the scope of the invention is to be construed in accordance with the substance defined by the following claims.

What is claimed is:

1. An illuminator comprising:

a housing;

a substrate within the housing;

a plurality of LEDs arranged in an array and mounted to the substrate; and a pump located to cause a flow of a coolant liquid through apertures in the substrates;

wherein the substrate is apertured adjacent to each of the LEDs in the array.

2. The illuminator of claim 1 wherein the substrate divides the housing into a front portion and a rear portion with the LEDs in the front portion, the illuminator comprises a conduit providing fluid communication between the front and rear portions and the pump is disposed to circulate the coolant liquid through the conduit.

3. The illuminator of claim 1 comprising a collimating plate located to reduce a divergence of a beam of light issuing from the array of LEDs.

4. The illuminator of claim 1 wherein the substrate has more than one aperture for each LED in the array.

5. The illuminator of claim 1 wherein the substrate comprises a printed circuit board and the illuminator comprises traces on the printed circuit board, the traces connected to supply electrical power from a power supply to each of the LEDs.

6. The illuminator of claim 1 wherein a total power of the LEDs is in excess of 25 W.

7. The illuminator of claim 6 wherein the array comprises at least 400 LEDs.

8. The illuminator of claim 6 wherein within the array there is a circular area of 3 cm or less in diameter within which there are LEDs which consume at least 1,500 mW of electrical power in operation.

9. The illuminator of claim 8 wherein the circular area contains at least 20 LEDs.

10. The illuminator of claim 8 wherein the circular area contains at least 40 LEDs.

11. The illuminator of claim 1 wherein a total power of the LEDs is in excess of 50 W.

12. The illuminator of claim 1 wherein a ratio of an aggregate power of the LEDs to an area of a surface of the substrate to which the LEDs are mounted is at least 400 $mW/cm^2$.

13. The illuminator of claim 12 wherein an aggregate area of the apertures of the substrate is at least 1,000 $mm^2$.

14. The illuminator of claim 13 wherein a ratio of the aggregate area of the apertures to a total number of the LEDs on the substrate is at least 1.8 $mm^2$ per LED.

15. The illuminator of claim 14 wherein, for each of the LEDs, within a circle having a radius equal to a distance from the LED to a nearest-neighboring LED, there are apertures having an aggregate area exceeding 9 $mm^2$ multiplied by a power of the LED in Watts.

16. The illuminator of claim 1 wherein a ratio of the aggregate area of the apertures to a total number of the LEDs on the substrate is at least 1.8 $mm^2$ per LED.

17. The illuminator of claim 16 wherein, for each of the LEDs, within a circular area having a radius equal to a distance from the LED to a nearest-neighboring LED, there are apertures having an aggregate area exceeding 9 $mm^2$ multiplied by a power of the LED in Watts.

18. The illuminator of claim 1 wherein the LEDs emit radiation at infrared wavelengths.

19. The illuminator of claim 18 comprising an absorber located to block transmission of light from the LEDs at visible wavelengths.

20. A night vision system comprising an illuminator according to claim 18 configured to provide an infrared light beam having a first width at a viewing distance and an infrared-sensitive camera having a field of view at the viewing distance substantially equal to the first width.

21. The illuminator of claim 1 comprising at least 560 LEDs on the substrate.

22. The illuminator of claim 1 wherein the substrate is curved.

23. The illuminator of claim 22 wherein each of the LEDs is oriented to issue a beam of light in a direction substantially normal to a portion of the substrate on which the LED is located.

24. The illuminator of claim 23 wherein the substrate comprises a printed circuit board and the printed circuit board is held in a curved configuration against one or more abutment surfaces in the housing.

* * * * *